US006755737B2

(12) United States Patent
Jackson et al.

(10) Patent No.: US 6,755,737 B2
(45) Date of Patent: Jun. 29, 2004

(54) GAMING MACHINE HAVING BONUS GAME

(75) Inventors: James P. Jackson, Henderson, NV (US); Robert J. Piechowiak, Las Vegas, NV (US); Frank DeSimone, Henderson, NV (US); Michael Thomas Dini, Las Vegas, NV (US)

(73) Assignee: Sigma Game, Inc., Las Vegas, NV (US)

( * ) Notice: Subject to any disclaimer, the term of this patent is extended or adjusted under 35 U.S.C. 154(b) by 0 days.

(21) Appl. No.: 09/967,629

(22) Filed: Sep. 28, 2001

(65) Prior Publication Data

US 2003/0064797 A1 Apr. 3, 2003

(51) Int. Cl.[7] ..... A63F 9/24
(52) U.S. Cl. ..... 463/16
(58) Field of Search ..... 463/16–20, 25–29, 463/40–43; 273/143 R, 274, 272, 269, 138.1

(56) References Cited

U.S. PATENT DOCUMENTS 6,089,976 A 7/2000 Schneider et al. ..... 463/16
6,149,521 A * 11/2000 Sanduski
6,159,097 A 12/2000 Gura ..... 463/20
6,190,255 B1 * 2/2001 Thomas et al.
6,193,606 B1 * 2/2001 Walker et al.
6,203,429 B1 * 3/2001 Demar et al.
6,220,593 B1 4/2001 Pierce et al. ..... 273/138.1
6,322,309 B1 * 11/2001 Thomas et al.
6,347,996 B1 * 2/2002 Gilmore et al.
6,398,218 B1 * 6/2002 Vancura
6,406,369 B1 * 6/2002 Baerlocher et al.
6,428,412 B1 * 8/2002 Anderson et al.
6,439,995 B1 * 8/2002 Hughs-Baird et al.
6,443,837 B1 * 9/2002 Jaffe et al.
6,482,089 B2 * 11/2002 DeMar et al.
6,494,785 B1 * 12/2002 Gerrard et al.
2002/0010018 A1 * 1/2002 Lemay et al.
2002/0016200 A1 * 2/2002 Baerlocher et al.
2002/0025844 A1 * 2/2002 Casey et al.
2002/0065126 A1 * 5/2002 Miller et al.
2002/0077173 A1 * 6/2002 Luciano et al.
2002/0082067 A1 * 6/2002 McKay et al.
2002/0187827 A1 * 12/2002 Blankstein

* cited by examiner

*Primary Examiner*—Michael O'Neill
(74) *Attorney, Agent, or Firm*—McDermott, Will & Emery

(57) ABSTRACT

In one embodiment of a gaming machine incorporating the present invention, a special outcome of a primary game initiates a bonus game of a type very different from the primary game. One of the outcomes of the bonus game is the initiation of a third game, which the player then plays to determine whether the bonus game ends or continues. This third game may be the random selection by the player or the gaming machine of one of a plurality of tiles (or other icons), where certain ones of the tiles end the bonus game and other ones of the tiles allow the bonus game to continue. The third game may be any game where a random result determines the ending of the bonus game, or the third game may be a game of skill, such as a hand of blackjack. In one embodiment, the primary game, the bonus game, and the third game are played on the same touch video screen, where sensors in the screen detect the position of a player's touch in order to select a displayed option.

23 Claims, 9 Drawing Sheets

GAMING MACHINE HAVING BONUS GAME

FIELD OF INVENTION

This invention relates to gaming machines and, in particular, to a bonus game feature in a gaming machine.

BACKGROUND

Gaming machines, such as video and reel-type slot machines, have become more entertaining to the player due to the addition of secondary games. Such secondary games, sometimes referred to as bonus games, are only made available to the player after a special outcome of the primary game. For example, such a special outcome to initiate the bonus game may be the occurrence of a certain combination of special symbols on rotating reels (video reels or actual reels) or a certain combination of cards in a video poker machine. Some bonus games are simply a variation of the primary game, and other bonus games are a completely different type of game.

Such bonus games provide the opportunity for the player to obtain an additional award and, thus, entice the player to play those gaming machines that offer bonus games.

Typical bonus games involve the simple random selection of a bonus result by the gaming machine or allow the player to make some selection to determine the outcome of the bonus game. Once such gaming machine is described in U.S. Pat. No. 6,190,255, incorporated herein by reference. In such typical bonus games, the bonus game ends after a single outcome or ends abruptly after the player or the gaming machine randomly chooses a losing option instead of a winning option while playing the bonus game.

SUMMARY

In one embodiment of a gaming machine incorporating the present invention, a special outcome of a primary game initiates a bonus game of a type very different from the primary game. The bonus game may be a game board displayed on a video screen, where the player spins a virtual spinner to progress through the game board. Landing on some positions on the game board increment or decrement a bonus prize. Landing on certain other positions on the game board initiates a third game to determine whether the bonus game ends or continues. If the player lands on such a position, the player is prompted by a window on the video screen to pick one of three tiles representing three possible results. In one example, two of the results end the bonus game and one of the results allows the player to continue with the bonus game.

In another embodiment, upon a special outcome of the primary game, the player enters the bonus game and chooses unknown bonus values until selecting an option that initiates a third game to determine whether the bonus game ends or continues. This third game may be the random selection by the player or the gaming machine of one of a plurality of tiles (or other icons), where certain ones of the tiles end the bonus game and other ones of the tiles allow the bonus game to continue. The third game may be any game where a random result determines the ending of the bonus game, or the third game may be a game of skill, such as a hand of blackjack.

Numerous other embodiments of bonus games are envisioned that offer a third type of game to determine when the bonus game ends.

In one embodiment, the primary game, the bonus game, and the third game are played on the same touch video screen, where sensors in the screen detect the position of a player's touch in order to select a displayed option.

Using this invention, the player feels more in control of the bonus game, and the addition of the third game to determine if the bonus game ends heightens the suspense for the player.

DETAILED DESCRIPTION

Figure 1:
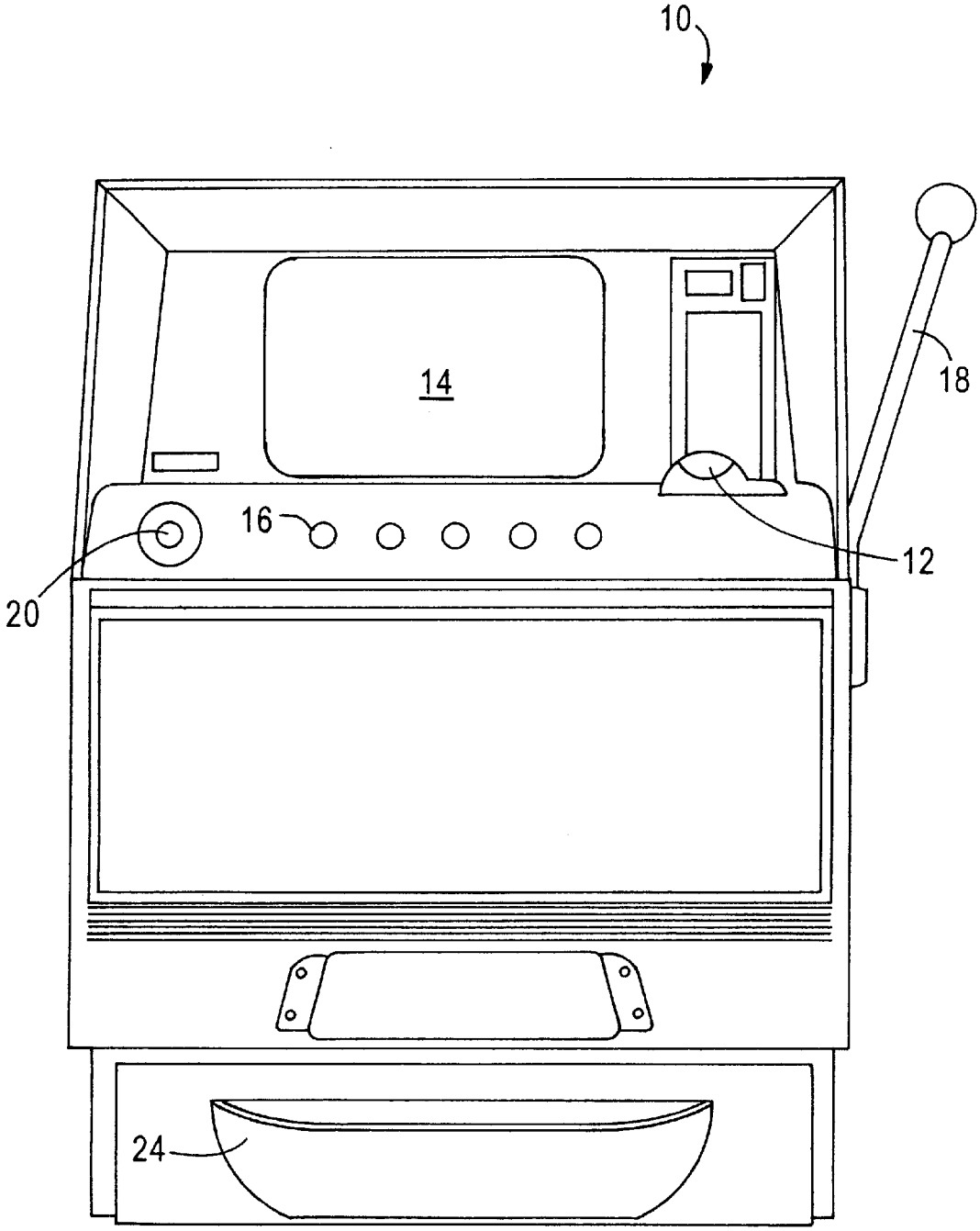
FIG. 1 is a front view of a video slot machine incorporating the present invention.

FIG. 1 is front view of a video gaming machine 10 in which the player inserts currency (or a monetary equivalent) into the machine to obtain credits. Such video game platforms are conventional, and the main differences between video gaming machines are basically the look of the front of the machines, the control buttons for allowing the player to make selections, and the programming of the various memory modules within the video gaming machine to carry out the video game routine.

Machine 10 includes a coin slot 12 and/or a slot for receiving paper currency or other monetary equivalent. All the various forms of making a wager are envisioned.

The number of credits available to the player is then displayed on a touch screen 14. Touch screens used in gaming machines are conventional. The player may input her selection via virtual buttons on screen 14, which the player touches to make a selection. Instead of using a touch screen, player input may be made by mechanical buttons 16, where the function of each button 16 is dependent upon the particular game to be played (e.g., video poker, video reels, etc.). One of the virtual or mechanical buttons 16 may be a bet button to allow the player to bet a certain number of available credits.

The player then pulls a handle 18 or presses a start button 20 to begin the primary game. The most common types of primary games are games that rotate simulated reels or video card games. One type of video gaming machine that rotates simulated reels is described in U.S. Pat. No. 6,159,097, incorporated herein by reference.

Depending upon the outcome of the primary game, the machine may issue credits, decrement credits, or initiate a bonus game. The initiation of the bonus game may also be accompanied by the player winning a certain number of credits. Ultimately, the player may cash out the credits by pressing a cash-out button. Upon cash-out, the equivalent number of coins may be deposited in an output tray 24 or, in other embodiments, a printed ticket having a code (e.g., a bar code) may be issued, a ticket having coded punched holes may be issued, a magnetic stripe on a card may be magnetically written to, a Smart Card memory may be credited, or the credits may be downloaded to a server for cashing out by the player at a later time.

Figure 2:
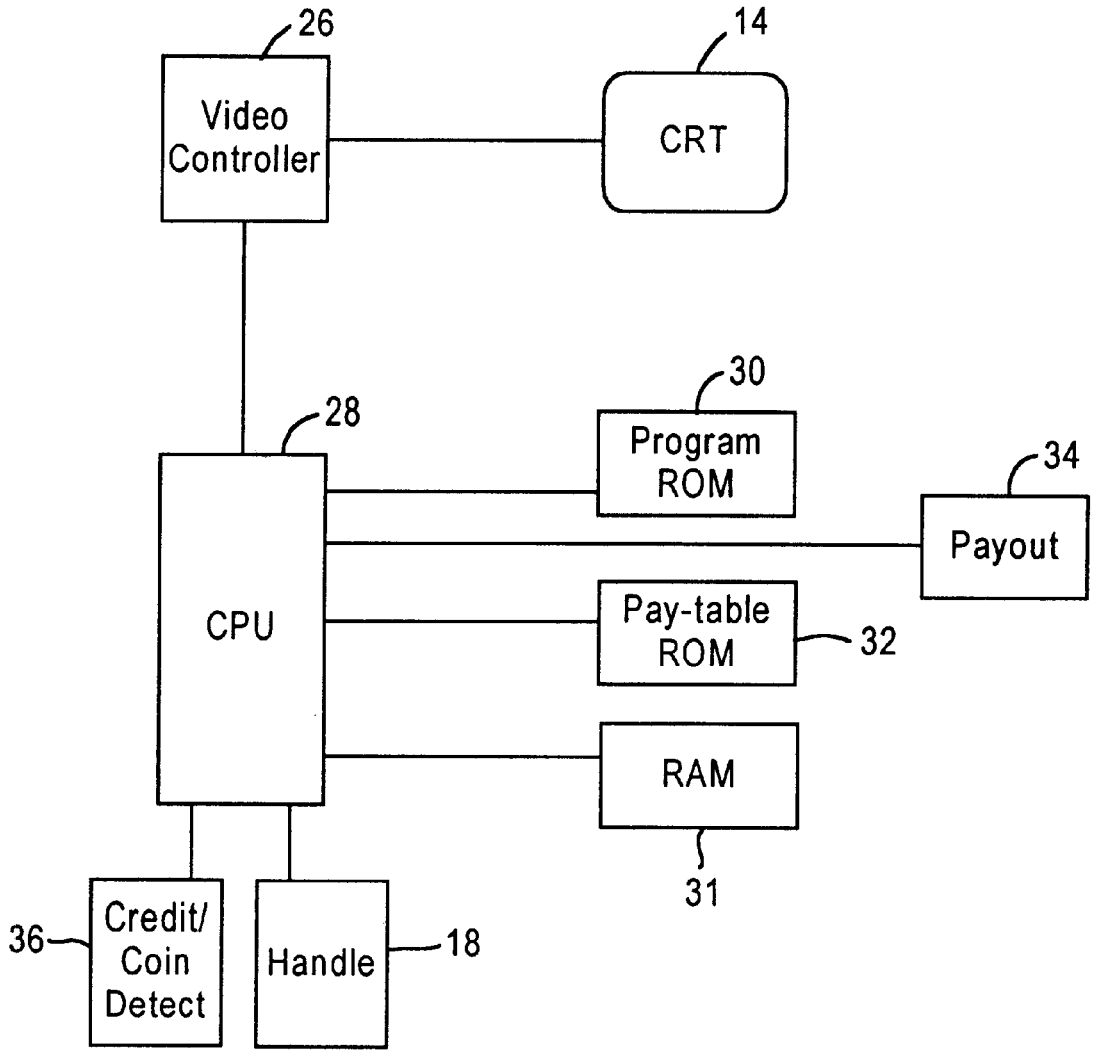
FIG. 2 is a block diagram of the basic components of a conventional gaming machine platform that can be used to implement the invention by programming memory in the machine with the video gaming routines.

FIG. 2 illustrates the basic components of the video gaming machine of FIG. 1, where touch screen 14 forms part of a CRT whose display is controlled by a video controller 26. Video controller 26 receives relatively simple signals output by a CPU 28 and controls the CRT to display the complex pixel images on the touch screen 14. A program ROM 30 contains the game program. The game program may be incorporated on a number of memory chips or a CD, and a separate memory may be provided for the primary game and the bonus game. A RAM 31 is used by CPU 28 for storing data during operation.

A pay-table ROM 32 receives a signal by CPU 28 identifying the outcome of the primary game or the bonus game and associates this signal with the number of award credits to be granted to the player. Upon the player cashing out, a payout mechanism 34 either controls a coin hopper to output coins or issues another form of payment, as previously described, depending on the particular gaming machine platform used.

A conventional credit/coin detector 36 detects that money has been deposited in order to play the game, and a conventional handle 18 (or play button) initiates the game.

Figure 3:
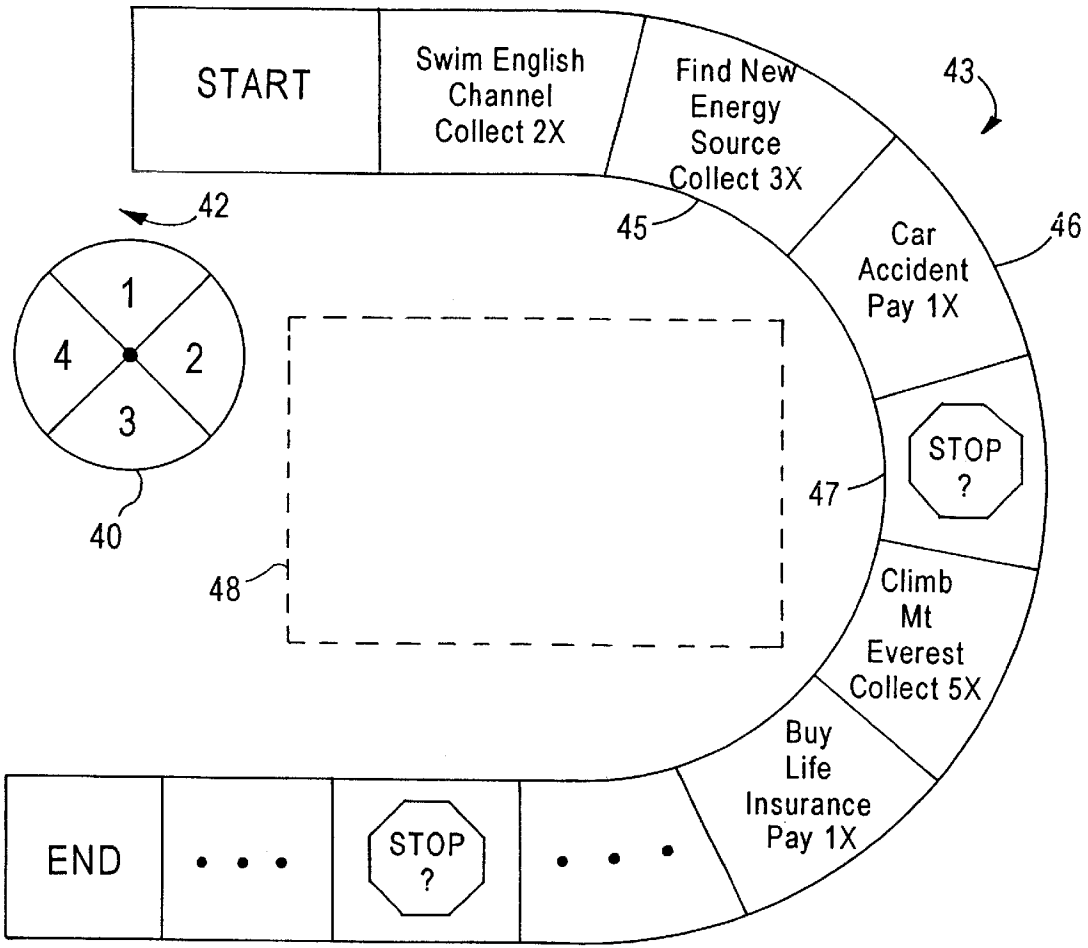
FIG. 3 is a simplified display of one type of video game that is used as the bonus game where a player moves around a game board.
Figure 4:
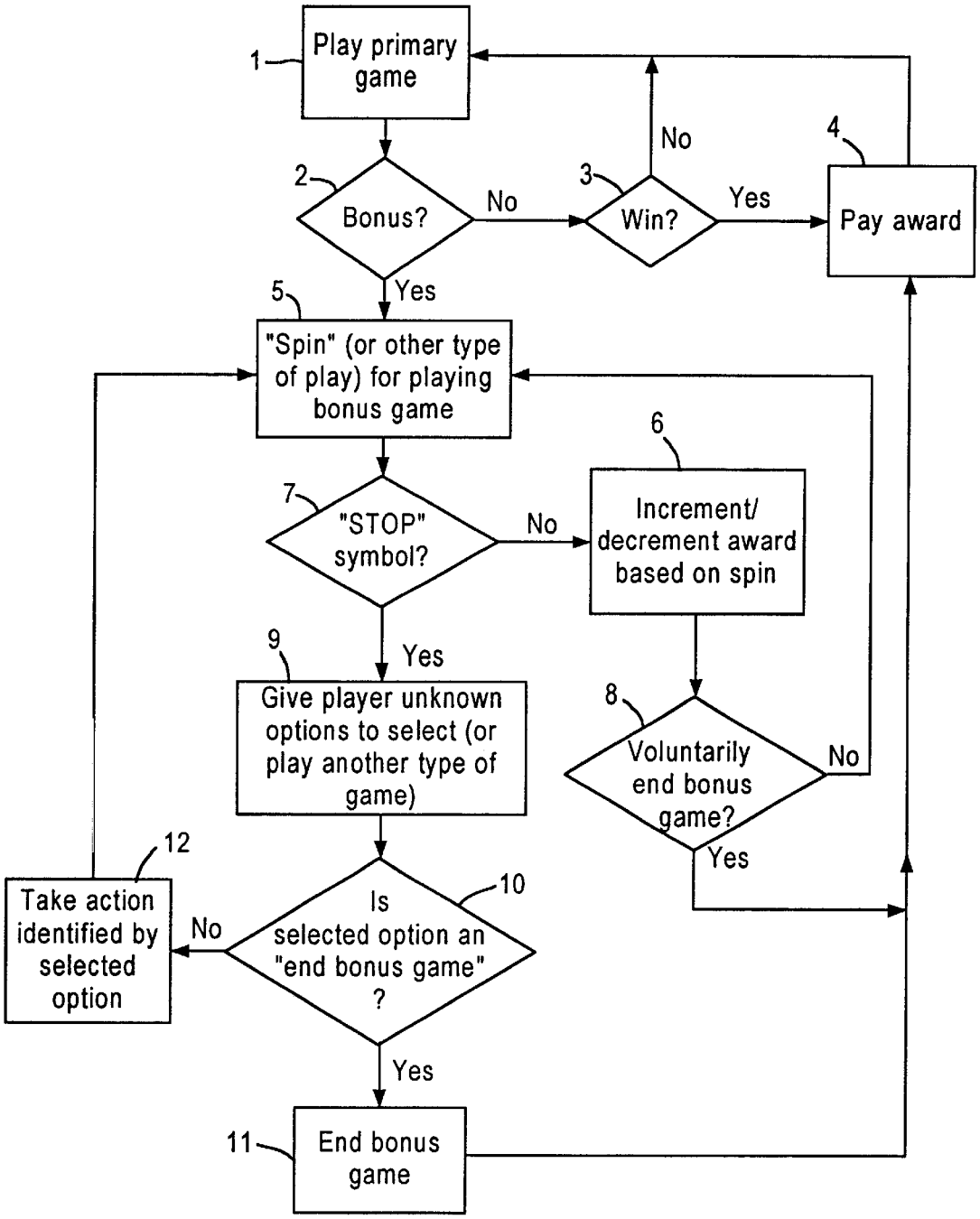
FIG. 4 is a flow chart of the basic steps for playing the bonus game of FIG. 3 and the third game of FIGS. 5 and 6.

FIG. 3 illustrates one possible type of bonus game, and FIG. 4 is a flowchart of steps carried out by the gaming machine 10.

The game designer chooses a particular outcome of the primary game that initiates a bonus game. This outcome may be a certain winning combination of, for example, three special bonus symbols on simulated rotating reels. This "initiate-bonus game" outcome may instead be certain card hands in video poker, such as any hands equal to or greater than three-of-a-kind.

In Step 1 of FIG. 4, the primary game is played. In Step 2, the CPU 28 (in conjunction with a memory) determines if the outcome of the primary game is to initiate a bonus game. If not, the CPU 28, in Step 3, determines if the outcome is a winning combination. If so, credits are awarded (Step 4), and the primary game is again played by the player. In one embodiment, the special outcome to initiate a bonus game also awards credits to the player.

The detection by CPU 28 of an initiate-bonus game outcome of the primary game addresses the bonus game program stored in the program ROM 30 to cause the bonus game to now be displayed on screen 14. Such a bonus game may be virtually any game, and the present invention primarily relates to the way in which the bonus game is terminated.

The bonus game illustrated in FIG. 3 simulates the well known board game called "THE GAME OF LIFE™" by Hasbro. In this particular bonus game, the player spins a virtual spinner 40 (Step 5) displayed on screen 14, which gradually stops at a random position, and the number of spaces to be moved on the virtual game board is identified by arrow 42. The player's position on the game board 43 may be identified by highlighting one of the rectangular positions on board 43.

In the example of FIG. 3, certain ones of the positions (e.g., position 45) multiply the player's award from the primary game and other ones of the positions (e.g., position 46) subtract from the accumulated award (Step 6). In another embodiment, the positions add or subtract a predetermined number of credits. Landing on certain other ones of the positions (e.g., position 47) initiates a third game to determine whether the bonus game ends or continues, and these positions are identified in FIG. 3 by a stop sign (Step 7).

Optionally, since there may be positions that decrement the award, the player is given the opportunity to voluntarily end the bonus game (Step 8).

Upon a player landing on the stop position 47, a window pops up on the screen, such as in the area within dashed outline 48 in FIG. 3. In another embodiment, the window occupies the full screen. The bonus game is temporarily stopped, and a new game (a third game) is commenced in which the player makes a selection which determines whether the bonus game will end or continue (Step 9).

Figure 5:
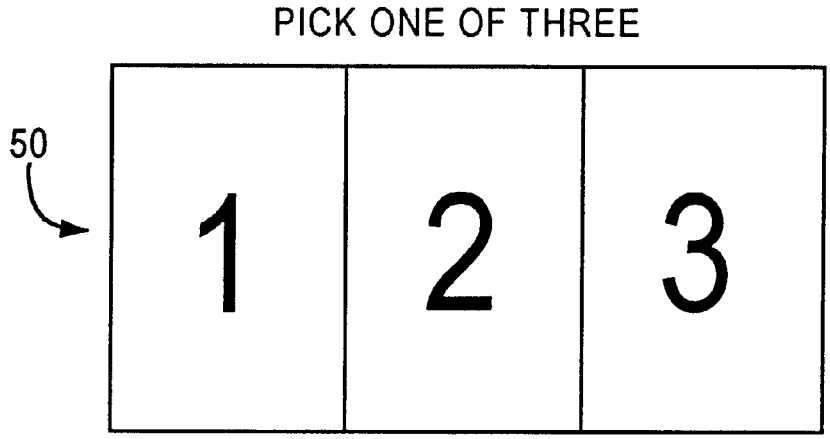
FIG. 5 illustrates a pop-up window that is displayed when a player lands on a "STOP?" position on the game board of FIG. 3, where the window is a third game in which the player makes a decision that either ends the bonus game or allows the player to continue the bonus game.

One example of the pop-up window 50 is shown in FIG. 5, where, as the third game, the player is given an option of three tiles to choose from. In one example, two of the options end the bonus game, and the third option allows the player to continue the bonus game (Step 10). The options associated with the tiles are changed by the machine after the third game is played.

Figure 6:
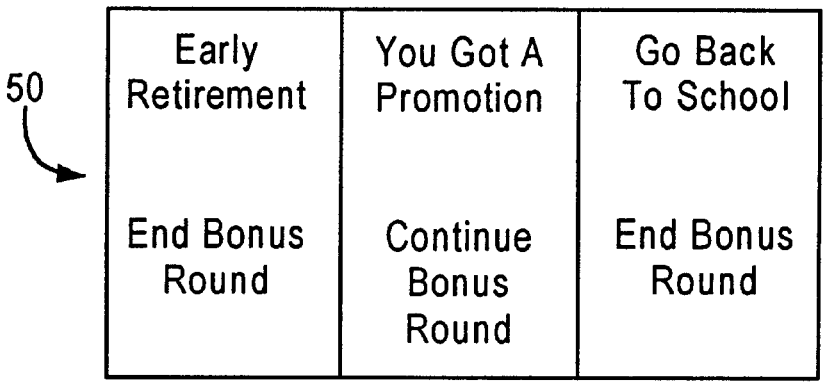
FIG. 6 illustrates the three options in FIG. 5 revealed.

One example of the various options offered by the tiles is given in FIG. 6, where options one and three end the bonus round (Step 11), requiring the player to bet additional credits to again play the primary game. Such end-bonus game options may also be coupled with an award multiplier, any additional payout, or a free play of the primary game. If the player chooses the middle tile, the player is then informed that she is allowed to continue with the bonus game and may spin again (Step 12). In one example, this tile also provides an additional award to the player. After the third game, the window 50 closes. The player may play the bonus game until the natural end of the bonus game (i.e., the player lands on the "end" position) or until the player picks an option that ends the bonus game.

Thus, in contrast to typical bonus games, the bonus game of the present invention does not automatically end upon a certain outcome during the bonus game but, instead, the bonus game initiates a different game that the player plays to either end the bonus game or continue the bonus game.

In another embodiment, the third game that determines whether the bonus game ends or continues is based on a random selection by the gaming machine. In another embodiment, the third game is an additional game such as a video reel game, a video card game (such as poker or blackjack) or any other game of chance or skill, where a win by the player continues the bonus game and a loss ends the bonus game. In yet another embodiment, the player is asked a trivia question or must solve a problem in order to continue with the bonus game.

Figure 10:
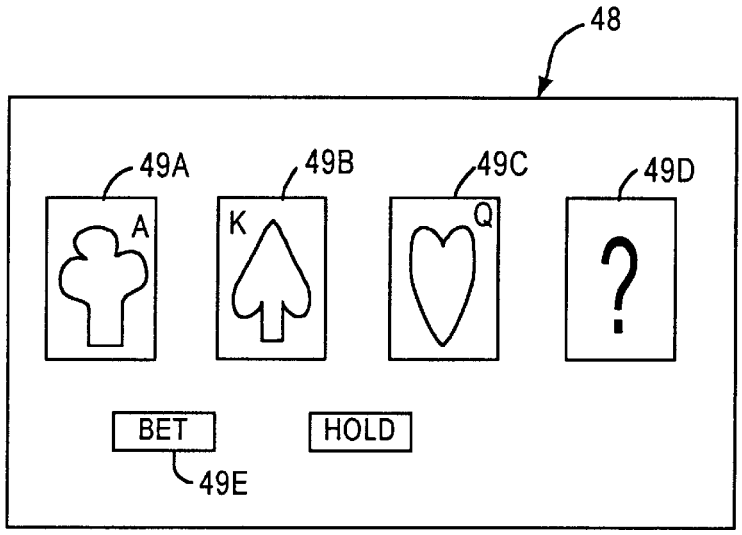

FIG. 10 illustrates an exemplary third game, for display in dashed outline 48 (see FIG. 3) which is a video card game. Various video card games, such as poker or blackjack, are common within the gaming industry and typically include a display of a plurality of cards 49*a*, 49*b*, 49*c*, 49*d* along with input buttons 49*e* to control wagering and game play.

In another embodiment of a bonus game, a board game similar to that shown in FIG. 3 is displayed, or a maze is displayed. The player spins or otherwise moves through positions on the board. The objective may be for the player to progress to the end position on the board, whereupon an additional bonus is paid. At each or at some of the positions, the player is presented with a challenge, where a successful outcome continues with the bonus game (and perhaps an award is paid), and failure to meet the challenge results in the bonus game being terminated. The challenges can include any of those described herein.

In another embodiment, the bonus game is a virtual casino, where the player proceeds through the casino and must play and win a series of casino games in order to advance to a certain level, such as "high roller" status. The first game in the bonus game may be a hand of blackjack, where a win by the player allows the player to proceed to the next casino game, and a loss ends the bonus game. The next game in the virtual casino may be poker, where winning or losing the hand determines if the player is allowed to continue with the bonus game. The next game may be a virtual slot machine, where the outcome determines if the player is allowed to continue with the bonus game. An example of a video poker game that may be adapted to be one of the third games is described in U.S. Pat. No. 6,149,521, incorporated herein by reference.

Figure 11:
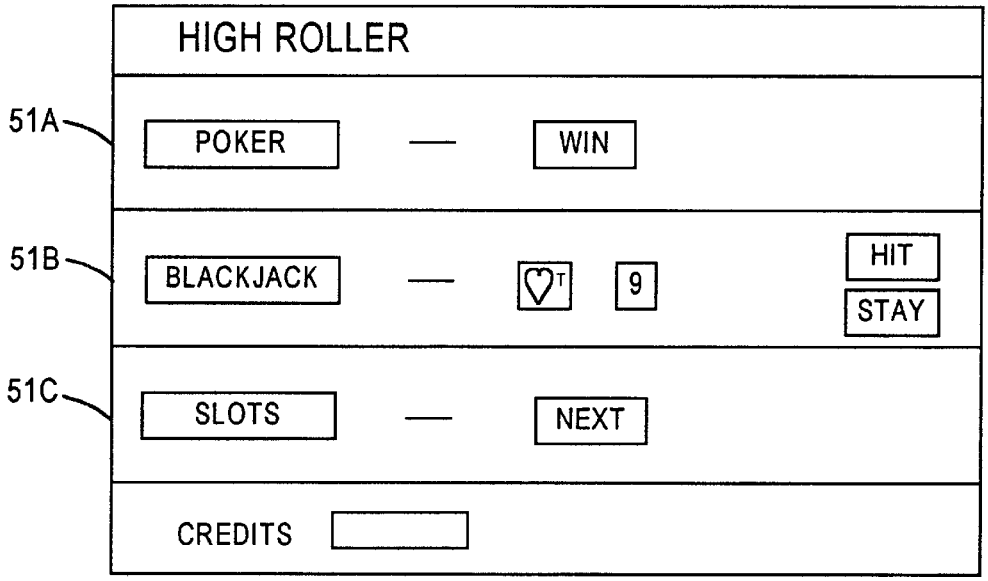

FIG. 11 illustrates an exemplary bonus game, which is a virtual casino as described in the above paragraph. In this exemplary illustration, the bonus game comprises a series of distinct casino games 51*a*, 51*b*, 51*c* that are played in succession as the player tries to attain, for example, a "high roller" status. In particular to FIG. 11, the player has won the first casino game of poker 51*a* and is currently playing the second casino game of blackjack 51*b*. Depending on the outcome of the blackjack game 51*b*, either the next game of slots 51*c* will be played or the virtual casino bonus game will end, without the player attaining "high roller" status.

The ultimate prize at the successful completion of the bonus game may be a predetermined award, a multiplier, or a progressive jackpot. Typically, upon the successful completion of the bonus game, the bonus game will end, and the player must deposit additional credits to again play the primary game.

It is believed that the additional control by the player of when the bonus game ends makes such a gaming machine more attractive to the player, thus, generating more revenue.

Figure 7:
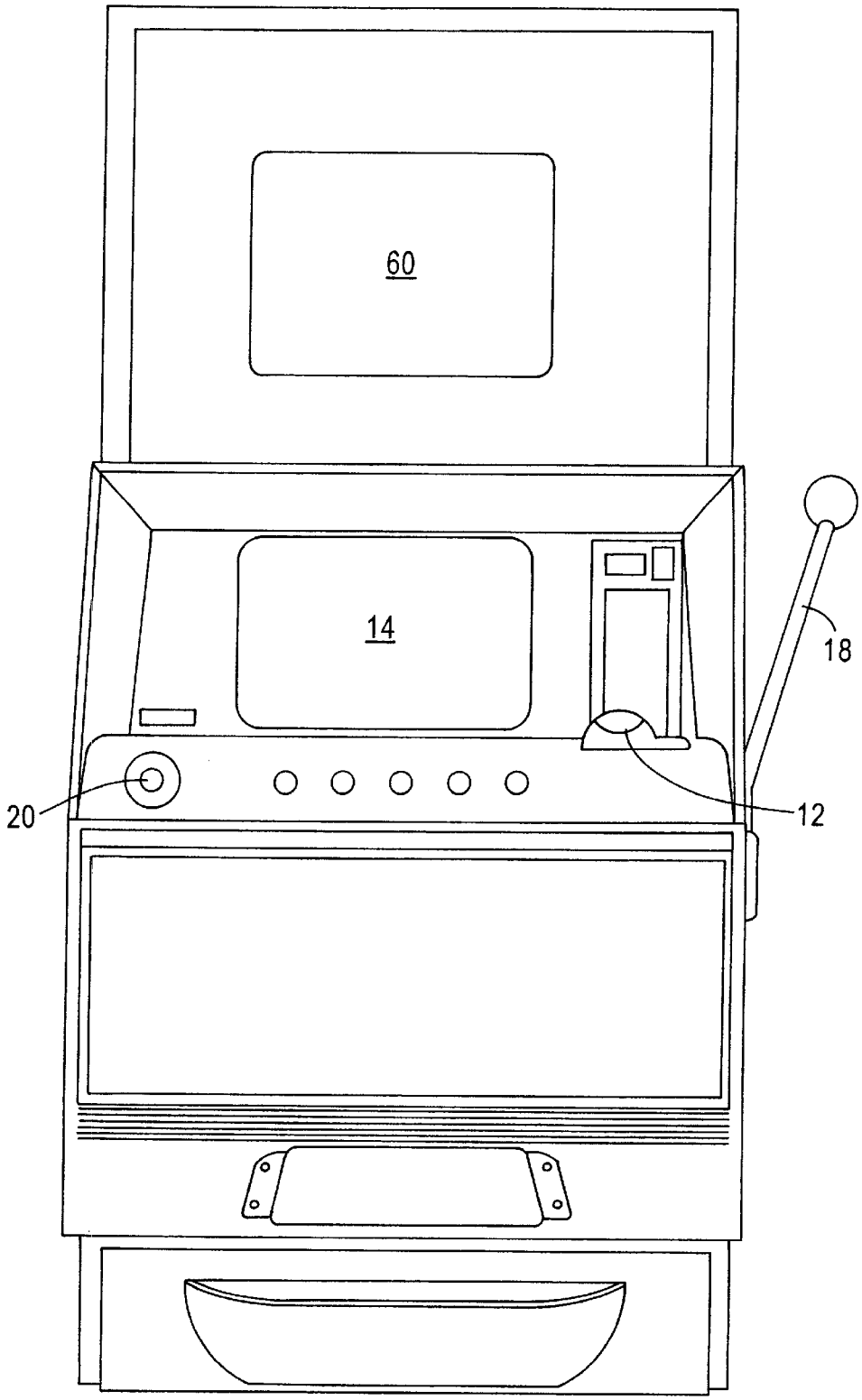
FIG. 7 illustrates another gaming machine platform that may be programmed to incorporate the present invention, where the platform has a lower video screen for displaying the primary game and an upper video screen or other type of display for displaying the bonus game and the third game.

The gaming machine platforms that may be used to implement this invention may take many forms. One form is shown in FIG. 7 where an additional display screen 60 displays the bonus game and the end-bonus game, while screen 14 displays the primary game.

Figure 8:
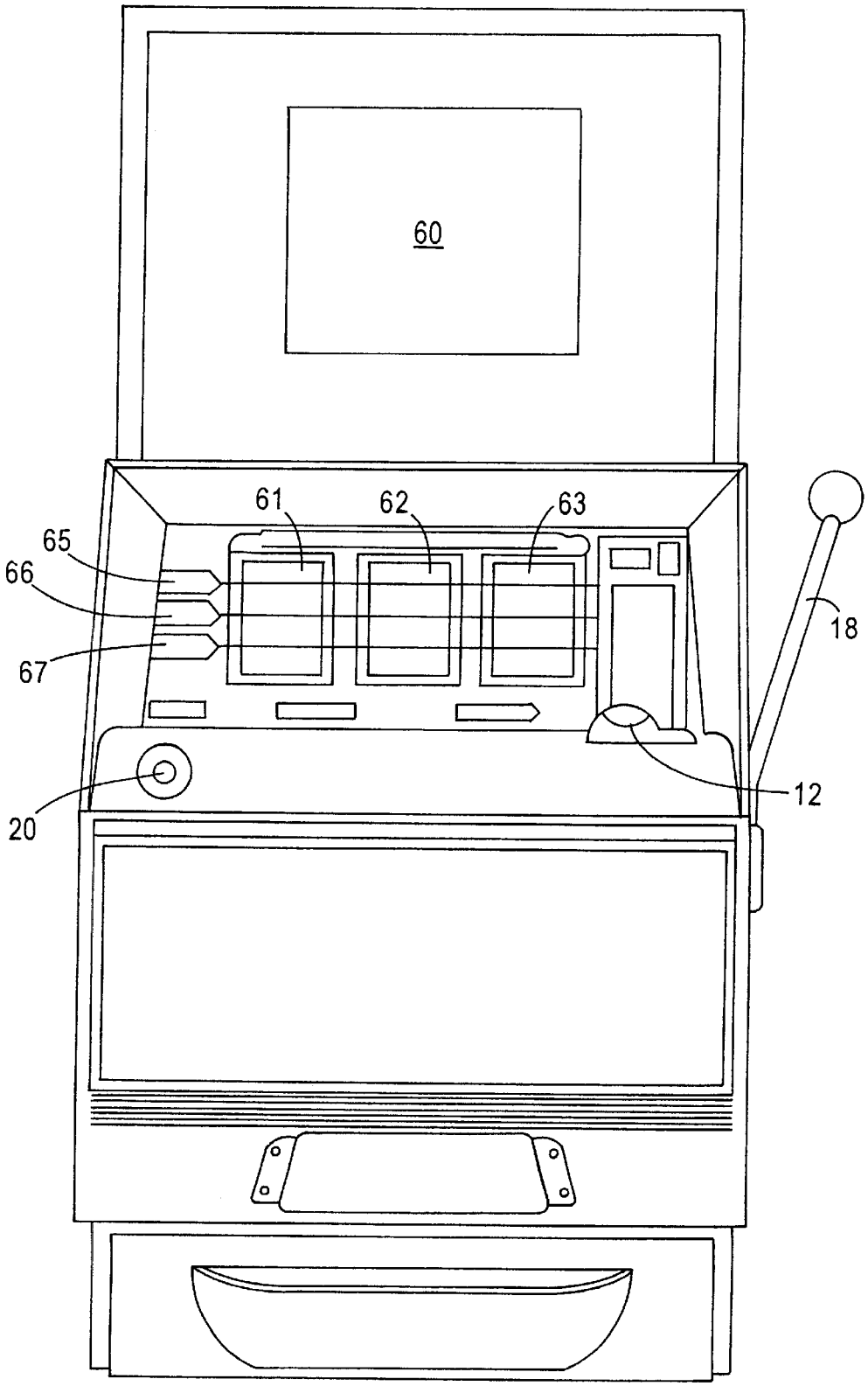
FIG. 8 is another type of gaming machine platform which may incorporate the present invention, where the primary game is a reel-type slot machine display, and the bonus game and third game are displayed on an upper video screen.

FIG. 8 illustrates another platform for the present invention, where motor-operated reels constitute the primary game, and the bonus game is displayed on screen 60. Display windows 61, 62, and 63 show three symbols on each of the reels, and three pay lines 65, 66, and 67 may be activated. A special combination of symbols, such as three bonus symbols, across any of the activated pay lines initiates the bonus game.

Figure 9:
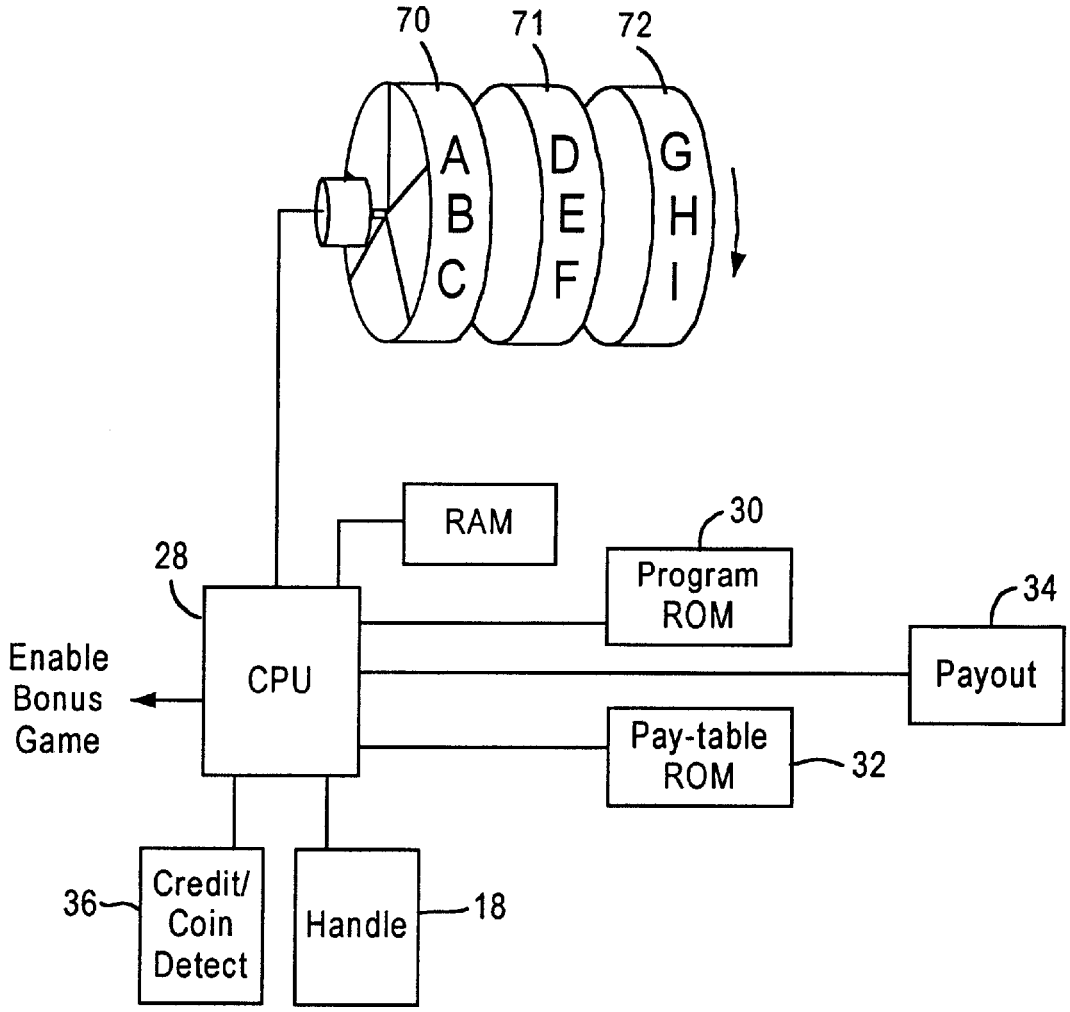
FIG. 9 illustrates the components of the reel-type primary game of FIG. 8.

FIG. 9 illustrates the functional blocks in the gaming machine of FIG. 8 for controlling the rotating reels 70, 71, and 72. The CPU 28 may be identical to the CPU in FIG. 2, or there may be a separate CPU (and additional circuitry) for the reel portion of the machine. In the event that the electronics are separated, the CPU in FIG. 9 may generate a signal to CPU 28 in FIG. 2 to initiate the bonus game. Otherwise, the hardware in FIGS. 2 and 9 may be identical.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A method performed by a gaming machine comprising:

(a) carrying out a primary game providing any of a plurality of first outcomes, at least one of said first outcomes allowing a player to play a bonus game;

(b) carrying out said bonus game upon obtaining said one of said first outcomes, said bonus game providing a plurality of second outcomes, at least one of said second outcomes initiating a third game to determine whether said bonus game is to end or continue;

(c) carrying out said third game to present to said player a plurality of player selectable options, said plurality of player selectable options representing a plurality of third possible outcomes, said one of a plurality of possible third outcomes including an end-bonus game outcome, ending said bonus game, and another of said plurality of possible third outcomes allowing said bonus game to continue; and (d) receiving from said player a choice of one option from among said plurality of player selectable options, said choice being received prior to revealing to said player which one of said plurality of third possible outcomes is associated with said choice.

2. The method of claim 1 further comprising:

after said bonus game has ended, requiring said player to bet credits to again carry out said primary game.

3. The method of claim 1 wherein said bonus game is conceptually different from said primary game.

4. The method of claim 1 wherein carrying out said primary game comprises pseudo-randomly stopping rotating reels displaying symbols, at least one symbol combination initiating said bonus game.

5. The method of claim 4 wherein said reels are displayed on a video screen.

6. The method of claim 1 further comprising displaying said primary game, said bonus game, and said third game on a video screen.

7. The method of claim 6 wherein said video screen is a touch screen.

8. The method of claim 1 wherein said carrying out said bonus game comprises:

moving through positions on a virtual board game displayed on a screen, said player landing on at least one position initiating said third game, a successful outcome of said third game allowing said player to continuing playing said bonus game, and an unsuccessful outcome of said third game ending said bonus game.

9. The method of claim 8 wherein said moving comprises spinning a virtual spinner identifying a number of positions to be moved on said board.

10. The method of claim 8 wherein said virtual board displays a maze.

11. The method of claim 8 wherein other ones of said positions do not initiate said third game.

12. The method of claim 1 wherein said carrying out said third game comprises said player being presented with a plurality of unknown choices, and said player choosing one of said choices.

13. The method of claim 1 wherein said carrying out said third game comprises said player playing a game of chance.

14. The method of claim 13 wherein said game of chance comprises a card game.

15. The method of claim 1 wherein said carrying out said third game comprises said player being presented with a question, a correct answer of said question allowing said bonus game to continue.

16. The method of claim 1 wherein carrying out said primary game comprises playing a card game.

17. The method of claim 1 wherein a successful completion of said bonus game awards a bonus to said player.

18. The method of claim 17 wherein a successful completion of said bonus game awards a progressive bonus to said player.

19. A method performed by a gaming machine comprising:

(a) carrying out a primary game providing any of a plurality of first outcomes, at least one of said first outcomes allowing a player to play a bonus game;

(b) carrying out said bonus game upon obtaining said one of said first outcomes, said bonus game providing a plurality of third games; and (c) carrying out at least one of said third games to present to said player a plurality of player selectable options, said plurality of player selectable options representing a plurality of third possible outcomes, said one of a plurality of possible third outcomes including an end-bonus game outcome, ending said bonus game, and another of said plurality of possible third outcomes allowing said bonus game to continue; and (d) receiving from said player a choice of one option from among said plurality of player selectable options, said choice being received prior to revealing to said player which one of said plurality of third possible outcomes is associated with said choice.

20. The method of claim 19 wherein said bonus game comprises a virtual casino, and wherein said plurality of third games comprise a plurality of various casino games.

21. The method of claim 19 wherein said casino games comprise blackjack, a winning blackjack hand allowing said bonus game to continue on to another casino game, and a losing blackjack hand ending said bonus game.

22. A gaming machine comprising:

at least one processor in combination with computer instructions for performing a method comprising:

(a) carrying out a primary game providing any of a plurality of first outcomes, at least one of said first outcomes allowing a player to play a bonus game;

(b) carrying out said bonus game upon obtaining said one of said first outcomes, said bonus game providing a plurality of second outcomes, at least one of said second outcomes initiating a third game to determine whether said bonus game is to end or continue;

(c) carrying out said third game to present to said player a plurality of player selectable options, said plurality of player selectable options representing a plurality of third possible outcomes, said one of a plurality of possible third outcomes including an end-bonus game outcome, ending said bonus game, and another of said plurality of possible third outcomes allowing said bonus game to continue; and (d) receiving from said player a choice of one option from among said plurality of player selectable options, said choice being received prior to revealing to said player which one of said plurality of third possible outcomes is associated with said choice.

23. A gaming machine comprising:

at least one processor in combination with computer instructions for performing a method comprising:

(a) carrying out a primary game providing any of a plurality of first outcomes, at least one of said first outcomes allowing a player to play a bonus game;

(b) carrying out said bonus game upon obtaining said one of said first outcomes, said bonus game providing a plurality of third games;

(c) carrying out at least one of said third games to present to said player a plurality of player selectable options, said plurality of player selectable options representing a plurality of third possible outcomes, said one of a plurality of possible third outcomes including an end-bonus game outcome, ending said bonus game, and another of said plurality of possible third outcomes allowing said bonus game to continue; and (d) receiving from said player a choice of one option from among said plurality of player selectable options, said choice being received prior to revealing to said player which one of said plurality of third possible outcomes is associated with said choice.

* * * * *

UNITED STATES PATENT AND TRADEMARK OFFICE

CERTIFICATE OF CORRECTION

PATENT NO. : 6,755,737 B2
DATED : June 29, 2004
INVENTOR(S) : James P. Jackson et al.

It is certified that error appears in the above-identified patent and that said Letters Patent is hereby corrected as shown below:

Column 1,
Line 28, "bonus game. Once" should read -- bonus game. One --.

Column 2,
Line 39, insert the following:
-- Fig 10 illustrates an exemplary third game, for display in dashed outline 48 (FIG. 3) which is a video card game. Various video card games, such as poker or blackjack, are common within the gaming industry and typically include a display of a plurality of cards 49a, 49b, 49c, 49d along with input buttons 49e to control wagering and game play.
Fig 11 illustrates an exemplary bonus game, which is a virtual casino as described in the above paragraph. In this exemplary illustration, the bonus game comprises a series of distinct casino games 51a, 51b, 51c that are played in succession as the player tries to attain, for example, a "high roller" status. In particular to Fig. 11, the player has won the first casino game of poker 51a and is currently playing the second casino game of blackjack 51b. Depending on the outcome of the blackjack game 51b, either the next game of slots 51c will be played or the virtual casino bonus game will end, without the player attaining "high roller" status. --.

Column 7,
Line 21, "and" should be deleted.

Signed and Sealed this

Twenty-first Day of March, 2006

JON W. DUDAS
*Director of the United States Patent and Trademark Office*